US005143562A

United States Patent [19]

Boulos

[11] Patent Number: 5,143,562

[45] Date of Patent: Sep. 1, 1992

[54] BROADLY APPLICABLE PHOSPHATE CONVERSION COATING COMPOSITION AND PROCESS

[75] Inventor: Mervet S. Boulos, Troy, Mich.

[73] Assignee: Henkel Corporation, Ambler, Pa.

[21] Appl. No.: 786,694

[22] Filed: Nov. 1, 1991

[51] Int. Cl.[5] ..... C23C 22/34

[52] U.S. Cl. ..... 148/247; 148/271; 148/273

[58] Field of Search ..... 148/262, 259, 247, 275, 148/273

[56] References Cited

U.S. PATENT DOCUMENTS 3,682,713 8/1972 Ries ..... 148/247

FOREIGN PATENT DOCUMENTS 0763628 4/1971 Belgium ..... 148/262
2506349 8/1976 Fed. Rep. of Germany ..... 148/259
1198546 7/1970 United Kingdom ..... 148/259

*Primary Examiner*—Sam Silverberg
*Attorney, Agent, or Firm*—Ernest G. Szoke; Wayne C. Jaeschke; Norvell E. Wisdom, Jr.

[57] ABSTRACT

An aqueous liquid combination of simple and complex fluorides, a chelating agent for iron, phosphate ions, a hydroxylamine source, and an oxidizing agent selected from among water soluble nitroaromatic organic compounds, molybdates, and tungstates, provides good quality protective phosphate conversion coatings on ferrous, zinciferous, aluminous, and magnesium and magnesium alloy metal surfaces, without needing any divalent or higher valent metal cations such as are generally used to produce high quality phosphate conversion coatings. If the combination includes suitable surfactants, no prior chemical cleaning of the metal to be treated is required for good results.

19 Claims, No Drawings

BROADLY APPLICABLE PHOSPHATE CONVERSION COATING COMPOSITION AND PROCESS

BACKGROUND OF THE INVENTION

1. Field of the Invention

This invention relates to a composition and process for forming a phosphate conversion coating on active metal surfaces in order to increase the corrosion resistance of the surfaces, either as treated or after subsequent conventional overcoating of the conversion coating layer formed by an organic based protective coating such as a paint or lacquer. Unlike many of the other compositions known for this general purpose, a composition according to this invention is well adapted to treating any of a variety of base metals, including at least steel and galvanized steel, zinc and zinc based alloys, aluminum and aluminum based alloys, and magnesium and magnesium based alloys. The composition and method of the invention are therefore especially well adapted to treating objects having surfaces including more than one type of active metal to be protected against corrosion.

2. Statement of Related Art

A wide variety of phosphate conversion coating compositions and processes are already described in the art. Those believed to be most closely related to the present invention are described below.

U.S. Pat. No. 4,865,653 of Sep. 12, 1989 to Kramer teaches the use of hydroxylamine or agents that react in water to produce hydroxylamine in zinc phosphating solutions to expand the range of zinc concentrations over which the most desirable coating morphology for a zinc phosphate conversion coating can be obtained. Ferrous, zinciferous, and aluminum surfaces can all be coated with the compositions and processes taught by this reference.

U.S. Pat. No. 4,637,838 of Jan. 20, 1987 to Rausch et al. teaches zinc phosphating solutions optionally containing nitrobenzene sulfonate, nitrilotriacetate, fluoride and complex fluoride anions, and/or chelators such as citrate and tartrate.

U.S. Pat. No. 4,149,909 of Apr. 17, 1979 to Hamilton teaches using a combination of accelerators including an oxidizing agent such as a chlorate or bromate in conjunction with a reducing agent such as hydroxylamine sulfate to phosphate ferrous metal surfaces at low temperatures to produce an iron phosphate coating with good salt spray corrosion resistance.

U.S. Pat. No. 4,148,670 of Apr. 10, 1979 to Kelly teaches treating aluminum with an aqueous composition comprising a zirconium or titanium compound which may be the fluozirconate or fluotitanate, a fluoride compound which may also be the noted complex fluoride compounds, and phosphate ions.

U.S. Pat. No. 3,619,300 of Nov. 9, 1971 to Heller et al. teaches zinc phosphate conversion coating compositions containing zinc, phosphate, nitrate, and nitrite ions along with a combination of fluoride and bifluorides of sodium and potassium and teaches that such compositions are useful for treating aluminum, iron, and/or zinc based surfaces.

A commercial product of Henkel Corporation sold for phosphate conversion coating processes more than one year before this application contains phosphate ions, nitrobenzene sulfonate ions, hydroxylammonium sulfate, sodium xylene sulfonate, the monobutyl ether of diethylene glycol {i.e., $HO—(CH_2)_2—O—(CH_2)_2—O—(CH_2)_3CH_3$}, and surfactant. Another commercial product of Henkel Corporation sold for more than one year before this application for phosphate conversion coating contains phosphate, hydroxylammonium sulfate, sodium molybdate, sodium sulfate, surfactants, an antifoam agent, and a siliceous desiccant. However, neither of these two commercial products contains any simple or complex fluorides or any organic compounds containing two or more hydroxide and/or carboxyl functional groups.

DESCRIPTION OF THE INVENTION

In this description, except in the working examples and claims and wherever expressly indicated to the contrary, all numerical specifications of amounts of materials or conditions of reaction or use are to be understood as modified by the term "about" in describing the broadest scope of the invention. Practice of the invention within the exact numerical limits given is generally preferred.

SUMMARY OF THE INVENTION

A composition according to this invention is an aqueous liquid composition comprising, or preferably consisting essentially of, still more preferably consisting of, water and:

(A) a water soluble component providing in aqueous solution dissolved complex fluoride ions selected from the group consisting of fluoborate ($BF_4^{-2}$), fluohafnate ($HfF_6^{-2}$), fluosilicate ($SiF_6^{-2}$), fluotitanate ($TiF_6^{-2}$), fluozirconate ($ZrF_6^{-2}$), and mixtures thereof;

(B) a water soluble component providing in aqueous solution ions selected from the group consisting of fluoride ($F^-$), bifluoride ($HF_2^-$), and mixtures thereof;

(C) a water soluble iron chelating agent component selected from molecules each of which contains at least two, and preferably at least three, moieties selected from the group consisting of —COOH, —OH, and mixtures thereof;

(D) a water soluble component source of dissolved hydroxylamine in aqueous solution;

(E) a water soluble source of dissolved phosphate ions; and (F) a water soluble component providing in aqueous solution dissolved oxidizing agents selected from the group consisting of nitroaromatic organic compounds, molybdate and condensed molybdate ions having the general formula $Mo_nO_{(3n+1)}^{-2}$ where n represents a positive integer, tungstate ions, and mixtures thereof; and, optionally and preferably, (G) a component including one or more surfactants to promote cleaning of the metal surface to be treated; and, optionally, (H) a hydrotrope component to increase the solubility of the constituents of component (G); and, optionally, (J) a component of antifoam agent or agents.

A process according to this invention comprises at a minimum a step of contacting a metal surface to be treated with a composition according to the invention for a sufficient time to form on the metal surface a detectable conversion coating. The compositions according to this invention, when they contain adequate amounts and types of surfactant component (G) as is usually preferred, are especially well suited to treating metal surfaces that have not been subjected to any prior chemical cleaning or conventional "activation" (e.g., contact with a suitably prepared aqueous dispersion of colloidal titanium compounds), but conventional metal surface cleaning and/or activation steps before contact between the metal to be treated and the compositions according to the invention may be used if desired as part of a process according to this invention.

A process according to the invention also may, and usually preferably does, include conventional steps subsequent to the contact between the metal surface to be treated and the compositions according to the invention. These subsequent steps, e.g., may include rinsing with water, any conventional reactive post treatments, e.g., with compositions according to the teachings of U.S. Pat. No. 4,963,596 or with chromate containing solutions, and painting or otherwise protecting the surface with an outer coating of an organic based solid material.

DESCRIPTION OF PREFERRED EMBODIMENTS OF THE INVENTION

With increasing preference in the order given and with independent preference for each noted component, compositions according to the invention contain no more than 4, 0.9, 0.5, 0.2, 0.07, or 0.01 grams per liter (hereinafter "g/L") of cations selected from the group consisting of $Zn^{+2}$, $Ni^{+2}$, $Mn^{+2}$, $Co^{+2}$, $Cu^{+2}$, $Fe^{+2}$, $Ca^{+2}$, $Mg^{+2}$, and all metal cations with a valence of 3 or higher.

Preferred sources for component (A) as described above are the acids and the alkali metal and ammonium salts having the anions noted. In a composition ready for use in a process according to this invention (briefly denoted hereinafter as a "working composition"), it is preferred, with increasing preference in the order given, that the concentration of component (A), calculated as the anion(s) present, be in the range from 0.05 to 1.0, 0.10 to 0.70, or 0.30 to 0.50 g/L.

However, for economy in shipment, it is often preferable to prepare a concentrated composition according to the invention, suitable for dilution with water, and optionally with addition of acid or base for pH control, at the point of use to prepare a working composition with a concentration of component (A) in the range given above and of other components in the ranges given below. In such a concentrate, the concentrations of all components except water preferably are in the range from 5 to 100, more preferably from 12 to 50, or still more preferably from 20 to 25, times the concentrations of the same components in a working composition.

For component (B) described above, the most preferred source is hydrofluoric acid, and ammonium and alkali metal fluorides and bifluorides are otherwise preferred among other acceptable sources. In a working composition, it is preferred, with increasing preference in the order given, that the concentration of component (B), calculated as its stoichiometric equivalent of fluorine atoms, be in the range from 0.1 to 2.0, 0.2 to 0.8, or 0.4 to 0.7 g/L.

For component (C) described above, the most preferred source is gluconic acid and/or its salts, and citric acid and its salts are otherwise preferred among other acceptable sources. In a working composition, it is preferred, with increasing preference in the order given, that the concentration of component (C) be in the range from 0.0005 to 0.05, 0.001 to 0.015, or 0.0025 to 0.008 gram-equivalents per liter (hereinafter "g-eq/L"), with the gram-equivalent for this purpose being defined as the quotient of twice the molecular weight in grams of the component divided by the total number of hydroxyl and carboxyl groups per molecule. (i.e., if the molecular weight of the component is $MW_c$ and the total number of hydroxyl and carboxyl groups in a molecule of the component is n, the gram-equivalent for this molecular type of component $=2(MW_c)/n$. This means that an equivalent is the amount of the component required to provide two coordination bonds to each of Avogadro's number $\{=6.0\times10^{23}\}$ of iron cations.) If more than one molecular type is used for component (C), the numbers of gram-equivalents of all types present are calculated separately and added together to determine the concentration of component (C) overall.

For component (D) the most preferred source is hydroxylamine sulfate (briefly denoted hereinafter as "HAS"), but many other sources are satisfactory. In a working composition, it is preferred, with increasing preference in the order given, that the concentration of component (D), calculated as its stoichiometric equivalent of hydroxylamine ($H_2NOH$), be in the range from 0.1 to 10, 0.5 to 6, or 0.5 to 2.0, g/L.

For component (E) the most preferred source is orthophosphoric acid ($H_3PO_4$) and/or its alkali metal and ammonium salts. The acid itself and all anions produced by its partial or total ionization in aqueous solution are considered part of component (E) as described herein. In a working composition, it is preferred, with increasing preference in the order given, that the concentration of component (E), calculated as its stoichiometric equivalent as phosphoric acid ($H_3PO_4$), be in the range from 3 to 30, 7 to 15, or 5 to 12, g/L.

In one embodiment of the invention, the most preferred sources of component (F) are water soluble salts of one of the molybdic acids, most preferably of $H_2MoO_4$. This component provides a dark blue colored conversion coating that is easy to detect visually and gives good corrosion protection, adequate for many purposes. This embodiment is generally preferred by users who do not wish to quantitatively monitor the thickness of the coating produced. In a working composition of this embodiment, it is preferred, with increasing preference in the order given, that the total concentration of (F) be in the range from 0.00002 to 0.02, 0.0002 to 0.02, or 0.002 to 0.02 grammoles per liter (hereinafter "M") of total molybdate salts.

In another embodiment of the invention, which produces the maximum possible corrosion resistance, paranitrobenzene sulfonic acid and/or its water soluble salts, especially the sodium salt, are the most preferred source of component (F). The conversion coating layer produced by this embodiment is often difficult to detect visually, but the thickness of the coating can be readily determined by the quantitative methods known to those skilled in the art, which generally involve weighing a sample of the coating before and after using an appropriate stripping solution composition to remove the conversion coating. In a working composition according to this embodiment, it is preferred, with increasing preference in the order given, that the concentration of component (F) be in the range from 0.0001 to 0.1, 0.001 to 0.1, or 0.01 to 0.1M.

In a working composition, it is preferred, with increasing preference in the order given, that the concentration of component (G) be in the range from 0 to 100, 30 to 60, or 30 to 40, g/L. Preferred chemical types for component (G) are polyethoxylated alcohols with about 12–22 carbon atoms, other modified polyethers of the aliphatic or aromatic types, and salts of complex organic phosphate esters.

A hydrotrope is defined generally as a substance that increases the solubility in water of another material that is only partially soluble. Hydrotrope component (H) is needed in the compositions according to this invention only if the amount of component (G) desired in the compositions is so large as to exceed the limit of ready solubility in the absence of a hydrotrope. In such cases, adequate solubility to produce an optically clear and homogeneous composition as preferred can generally be achieved by use of a hydrotrope. A hydrotrope for this invention is preferably an ammonium or alkali metal salt of a sulfonate of toluene, xylene, or cumene, or a mixture of two or more such salts. The most preferred hydrotrope is sodium xylene sulfonate. A water soluble complex organo-phosphate ester or acid ester may often advantageously added as an auxiliary hydrotrope. In a working composition, it is preferred, with increasing preference in the order given, that the concentration of component (H) be in the range from 0 to 100, 20 to 60, or 30 to 40, g/L.

Preferred chemical types for component (J) are aliphatic petroleum distillates modified with hydrophobic silica and/or polyethoxylated alcohols. Block copolymers of ethylene oxide and propylene oxide may also be used. The amount used, if needed, should be sufficient to reduce the foaming of the composition to an acceptable level.

In a working composition, it is preferred, with increasing preference in the order given, that the concentration of free acid be in the range from 0.0 to 2.0, 0.0 to 1.0, or 0.2 to 1.0, "points" and that the concentration of total acid be in the range from 3 to 12, 5 to 10, or 6.0 to 9.0, "points". "Points" are defined for this purpose as the number of milliliters (hereinafter "ml") of 0.1N NaOH solution required to titrate a 10 ml sample of the composition, to a phenolphthalein end point for total acid and a bromthymol blue end point for free acid. Independently, it is preferred that the pH value of a working composition according to the invention be in the range from 3.0 to 7.0, 4.2 to 5.9, or 4.5 to 5.5.

For concentrated compositions according to the invention, it is more useful to characterize the preferred embodiments in terms of ratios of ingredients rather than specific concentrations as noted above for the working compositions. Specifically, it is preferred, with increasing preference in the order given for each ratio and with all components measured as described above for the concentration of working compositions according to the invention, that:

the ratio by weight of component (A) to component (B), be in the range from 0.3:1.0 to 1.6:1.0 , from 0.5:1.0 to 1.3:1.0, or from 0.6:1.0 to 0.9:1.0;

the ratio of g/L of component (B) to g-eq/L of component (C) be in the range from 15:1 to 300:1, from 42:1 to 155:1, or from 60:1 to 125:1;

the ratio of g-eq/L of component (C) to g/L of component (D) be in the range from 1:6 to 1:320, from 1:18 to 1:220, or from 1:38 to 1:130;

the ratio by weight of component (D) to component (E) be in the range from 1:8 to 1:80, from 1:12 to 1:59, or from 1:21 to 1:40;

the ratio of the concentration in g/L of component (E) to the total concentration in M of nitrobenzene sulfonic acid and its salts be in the range from 400:1 to 4000:1, from 860:1 to 2565:1, or from 1400:1 to 1800:1 and that the ratio of the concentration in g/L of component (E) to the total concentration in M of molybdate salts be in the range from 2000:1 to 20,000:1, from 4300:1 to 12,825:1, or from 7000:1 to 9000:1.

In determining these ratios, the components are to be measured in the same terms as described above for measuring the concentrations of the same components in working solutions.

In a process according to the invention, contact between the metal surface to be treated and a composition according to the invention may be accomplished by spraying, dipping, or any other convenient method or combination of methods. The temperature during contact between the metal treated and the composition according to the invention preferably is, with increasing preference in the order given, in the range from 21 to 85, 25 to 70, or 30 to 65, °C. The time of contact preferably is, with increasing preference in the order given, in the range from 5 sec to 15 minutes (hereinafter "min"), 15 sec to 10 min, or 30 sec to 5 min. The add-on mass of the phosphate coating formed preferably is, with increasing preference in the order given, in the range from 12 to 1600, 98 to 975, or 285 to 700, milligrams per square meter (hereinafter "mg/m$^2$") of surface treated.

Further appreciation of the present invention may be had from considering the following examples and comparative examples which are intended to illustrate, but not limit, the invention.

EXAMPLE and COMPARISON EXAMPLE Group 1

For Example 1, a concentrated composition according to the invention was prepared from the following amounts of the following ingredients ("w/o"=% by weight in aqueous solution), given in their order of use in preparation:

| Parts by Weight | Material |
|---|---|
| About 495 | Water |
| 140 | 50 w/o sodium hydroxide |
| 220 | 75 w/o orthophosphoric acid |
| 8 | 50 w/o gluconic acid |
| 50 | 40 w/o sodium xylene sulfonate |
| 5 | ANTAROX TM LF-330 |
| 8 | TRITON TM DF-16 |
| 25 | GAFAC TM RP-710 |
| 15 | Hydroxylamine sulfate |
| 22 | p-nitrobenzene sulfonic acid |
| 7 | 70 w/o hydrofluoric acid |
| 5 | Sodium fluoborate |

ANTAROX TM LF-330 is commercially available from GAF Chemicals Corporation and is reported to be a modified linear aliphatic polyether detergent and wetting agent with low foaming tendency. TRITON TM DF-16 is commercially available from Rohm & Haas Company and is reported to be a modified polyethoxylated straight chain alcohol nonionic low foaming detergent. GAFAC TM RP-710 is commercially available from GAF Chemicals Corporation and is reported to be a complex organic phosphate anionic detergent and emulsifier with hydrotropic effect on low foaming nonionic surfactants.

In preparing the concentrate, the sodium hydroxide is added to about 90% of the amount of water shown; the phosphoric acid is added next, with cooling until the temperature of the mixture falls to 43° C. or below.

Then the gluconic acid and the four surfactants were added in rapid succession and the mixture stirred until clear (about 15 min). The hydroxylamine sulfate and p-nitrobenzene sulfonic acid were then added, and 30 minutes additional mixing was allowed. Subsequently, the last two named ingredients were added, followed by another 30 minutes of mixing. The remaining water was then added, to the extent necessary to achieve the following conditions: a specific gravity of the concentrate within the range of 1.214 to 1.234 and a total acidity of 12.6±1.0 points and a free acidity of 0.9±0.1 points in a diluted composition containing 60 grams of the concentrated composition per liter of the diluted composition.

The concentrated composition as described above was diluted with water to produce a working composition containing 50 grams of the concentrated composition per liter of the working composition. This working composition had a pH value of 4.8 and a total acidity of 8.4.

Test panels of four types of active metal surfaces as follows were prepared:

| Metal Type | Letter Designation in Following Tables |
|---|---|
| Cold rolled carbon steel | A |
| "Minimum spangle" hot dip galvanized steel | B |
| Type 3003 aluminum alloy | C |
| Type 6061 aluminum alloy | D |

These test panels, without any preliminary chemical cleaning, were treated by a 90 sec spray of the above specified phosphate conversion coating composition according to the invention at a temperature of 49° C., rinsed in cold tap water for 30 sec, post treated for 30 sec with a chromium free aqueous composition having a pH of 6.3 and containing 1% by weight of a soluble polymer prepared as described in Example 1 of U.S. Pat. No. 4,970,264, rinsed for 15 sec with cold deionized water, and then dried. The phosphated panels were then coated with one of two conventional commercial paint overcoatings: DELUX TM 704 alkyd paint, commercially available from Du Pont, or DURACRON TM 200 acrylic paint, commercially available from PPG Industries, Inc.

Comparison examples 1.1–1.3 were performed in the same manner, except that the phosphating compositions and temperatures were those shown in Table 1. The painted panels were then subjected to conventional salt spray testing according to American Society for Testing Materials ("ASTM") Method B-117-90. Results are shown in Table 2.

TABLE 1

COMPOSITIONS AND TEMPERATURES FOR THE COMPARISON EXAMPLES OF GROUP 1

| Ingredient | Comparison Example Number 1.1 | 1.2 | 1.3 |
|---|---|---|---|
| | Percent by Weight of Ingredient in the Phosphating Composition Concentrate | | |
| $NaH_2PO_4$ | 15 | 83 | 80 |
| 75 w/o $H_3PO_4$ | 16 | 2.0 | 2.0 |
| $Na^+$ p-$NO_2C_6H_4SO_3^-$ | 1.3 | | |
| $(NH_4)_2MoO_4$ | | 2.0 | |
| $NH_4HF_2$ | | 8.0 | 5.0 |
| 60 w/o $H_2TiF_6$ | | | 4.8 |
| ANTAROX TM LF-330 | | 1.0 | 1.0 |
| ANTAROX TM LF-224 | | 0.5 | 0.5 |
| NALCO TM 2343 | 1.4 | | |
| TRITON TM CF-10 | 1.8 | | |
| TRITON TM X-114 | 1.0 | | |
| TRITON TM X-120 | | 2.0 | 2.0 |
| Pine Oil | 0.5 | 1.5 | 1.5 |
| KELZAN TM | 0.7 | | |
| Water | 62 | | |
| Operating Temperature, Degrees C | 49 | 66 | 49 |

Notes for Table 1
"w/o" means percent by weight and implies that the balance of the ingredient is water.
KELZAN TM is a xanthan gum used as a thickener.

TABLE 2

CORROSION TEST RESULTS FROM EXAMPLE AND COMPARISON EXAMPLE GROUP 1

| Phosphating Solution Reference | Metal Substrate Reference | Salt Spray Corrosion Test Results: With DELUX TM 704 Paint 72 Hrs | 168 Hrs | 240 Hrs | With DURACRON TM 200 Paint 72 Hrs | 168 Hrs | 240 Hrs |
|---|---|---|---|---|---|---|---|
| Ex 1 | A | 1–2 | 4–5 | 5% P | N | 0–1 | 1–1 |
| | B | 0–2, 2s | 1–4 | 1–5, 7s | N | 0–1 | 0–1 |
| | C | N | N | N | N | N | N |
| | D | N | N | N | N | N | N |
| CE 1.1 | A | 1–4, 6s | 6–12, 2% P | 75% P | 1–1 | 1–3, 2s | 2–5, 6s |
| | B | 2–2, 3s | 3–5, 6s | 10% P | 0–1 | 0–1, s | 0–2, 3s |
| | C | N | N | 0–1, s | N | N | N |
| | D | N | N | 0–1 | N | N | 0–1 |
| CE 1.2 | A | 55% P | — | — | 2–2 | 5–7, 1% P | 7–10, 2% P |
| | B | 3–4 | 8–10 | 60% P | 1–1 | 1–2.s | 2–3 |
| | C | 1–1 | 1–1, 2S | 1–2, s | N | N | N |
| | D | 1–1 | 1–1, 2s | 1–2, 4s | N | N | N |
| CE 1.3 | A | 8–8, 12s | 12–12, 15s | | | | |
| | B | 2–3 | 2–4 | | | | |
| | C | N | N | | | | |

Notes for Table 2
Ex = Example
CE = Comparison Example
Each result represents an average of three test panels.

EXAMPLE and COMPARISON EXAMPLE Group 2

These processes were the same as for Group 1, except that (i) only the DELUX TM 704 type paint was used after phosphating; (ii) the composition and operating temperature for Comparison Example 2 was the same as for Comparison Example 1.2 and the concentrated composition for Example 2 according to the invention was prepared from the following amounts of the following ingredients ("w/o" = % by weight in aqueous solution), given in their order of use in preparation:

| Parts by Weight | Material |
|---|---|
| About 425 | Water |
| 136 | 50 w/o sodium hydroxide |
| 210 | 75 w/o orthophosphoric acid |
| 19 | 50 w/o gluconic acid |
| 95 | 40 w/o sodium xylene sulfonate |
| 8 | ANTAROX TM LF-330 |
| 11 | TRITON TM DF-12 |
| 38 | GAFAC TM RP-710 |
| 13 | Hydroxylamine sulfate |
| 4 | Sodium molybdate (i.e., $Na_2MoO_4$) |
| 28 | Ammonium bifluoride (i.e., $NH_4HF_2$) |
| 13 | Sodium fluoborate |

TRITON TM DF-12 used in the composition for Example 2 is available from the same source as TRITON TM DF-16 and is the sane general type of surfactant, but with a slightly lower hydrophile-lipophile balance. Preparation of this composition was essentially the same as for Example 1, with the sodium molybate substituted for the p-nitrobenzene sulfonic acid used in EXAMPLE 1. Coating weights and corrosion results are shown in Table 3. The same notes as for Table 2 apply to Table 3.

TABLE 3

CORROSION TEST RESULTS AND COATING WEIGHTS FROM EXAMPLE AND COMPARISON EXAMPLE GROUP 2

| Phosphating Solution Reference | Metal Substrate Reference | Salt Spray Test Results With DELUX TM 704 Paint | | | Coating Weight, mg/m² |
|---|---|---|---|---|---|
| | | 24 Hrs | 72 Hrs | 168 Hrs | |
| Ex 2 | A | 1-1 | 4-5 | 12-16 | 237 |
| | B | 0-1, s | 2-4 | 4-11 | 118 |
| CE 2 | A | 2-2 | 8-9, 6% P | 100% P | 248 |
| | B | 1-1 | 5-6 | 35% P | 43 |

What is claimed is:

1. A liquid aqueous composition of matter, comprising water and:

(A) a water soluble component providing in aqueous solution dissolved complex fluoride ions selected from the group consisting of fluoborate ($BF_4^{-2}$), fluohafnate ($HfF_6^{-2}$), fluosilicate ($SiF_6^{-2}$), fluotitanate ($TiF_6^{-2}$), fluozirconate ($ZrF_6^{-2}$), and mixtures thereof;

(B) a water soluble component providing in aqueous solution ions selected from the group consisting of fluoride ($F^-$), bifluoride ($HF_2^-$), and mixtures thereof;

(C) a water soluble iron chelating agent component selected from molecules each of which contains at least two moieties selected from the group consisting of —COOH, —OH, and mixtures thereof;

(D) a water soluble component source of dissolved hydroxylamine in aqueous solution;

(E) a water soluble source of dissolved phosphate ions; and (F) a water soluble component providing in aqueous solution dissolved oxidizing agents selected from the group consisting of (i) p-nitrobenzene sulfonic acid, water soluble salts thereof, and mixtures thereof and (ii) water soluble salts of molybdic acids and mixtures thereof; and optionally, (G) a component including one or more surfactants to promote cleaning of the metal surface to be treated; and, optionally, (H) a hydrotrope component to increase the solubility of the constituents of component (G); and, optionally, (J) a component of antifoam agent or agents, wherein:

the ratio by weight of component (A) to component (B) is in the range from about 0.3:1.0 to about 1.6:1.0;

the ratio of g/L of component (B) to g-eq/L of component (C) is in the range from about 15:1 to about 300:1;

the ratio of g-eq/L of component (C) to g/L of component (D) is in the range from about 1:6 to about 1:320;

the ratio by weight of component (D) to component (E) is in the range from about 1:8 to about 1:80; and the ratio of the concentration in g/L of component (E) to the concentration in M of component (F) is in the range from about 2000:1 to about 20,000:1 if component (F) is made up of water soluble salts of molybdic acids or mixtures thereof and is in the range from about 400:1 to 4000:1 if component (F) is made up of p-nitrobenzene sulfonic acid, water soluble salts thereof, or mixtures thereof.

2. A composition according to claim 1, wherein:

the ratio by weight of component (A) to component (B) is in the range from about 0.5:1.0 to about 1.3:1.0:

the ratio of g/L of component (B) to g-eq/L of component (C) is in the range from about 42:1 to 155:1;

the ratio of g-eq/L of component (C) of g/L of component (D) is in the range from about 1:18 to about 1:220;

the ratio by weight of component (D) to component (E) is in the range from about 1:12 to about 1:59;

the ratio of the concentration in g/L of component (E) to the concentration in M of component (F) is in the range from about 4300:1 to about 12,825:1 if component (F) is made up of water soluble salts of molybdic acids or mixtures thereof and is in the range from about 860:1 to 2565:1 if component (F) is made up of p-nitrobenzene sulfonic acid, water soluble salts thereof, or mixtures thereof.

3. A composition according to claim 2, wherein:

the ratio by weight of component (A) to component (B) is in the range from about 0.6:1.0 to about 0.9:1.0;

the ratio of g/L of component (B) to g-eq/L of component (C) is in the range from about 60:1 to about 125:1;

the ratio of g-eq/L of component (C) to g/L of component (D) is in the range from about 1:38 to about 1:130;

the ratio by weight of component (D) to component (E) is in the range from about 1:21 to about 1:40; and the ratio of the concentration in g/L of component (E) to the concentration in M of component (F) is in the range from about 7000:1 to about 9000:1 if component (F) is made up of water soluble salts of molybdic acids or mixtures thereof and is in the range from about 1400:1 to 1800:1 if component (F)

is made up of p-nitrobenzene sulfonic acid, water soluble salts thereof, or mixtures thereof.

4. A composition according to claim 1, comprising:
from about 0.05 to about 1 g/L of component (A);
from about 0.1 to about 2 g/L of component (B);
from about 0.0005 to about 0.05 g-eq/L of component (C);
from about 0.1 to about 10 g/L of component (D);
from about 3 to about 30 g/L of component (E); and
from about 0.0001 to about 0.1M of component (F) if component (F) is selected from the group consisting of p-nitrobenzene sulfonic acid, water soluble salts thereof, and mixtures thereof and from about 0.00002 to about 0.02M of component (F) if component (F) is selected from the group consisting of water soluble salts of molybdic acids or mixtures thereof.

5. A composition according to claim 4 that has a free acid content in the range from 0 to about 2.0 points, a total acid content in the range from about 3 to about 15 points, and a pH in the range from about 3.0 to about 7.0 and that comprises:
from about 0.10 to about 0.70 g/L of component (A);
from about 0.2 to about 0.8 g/L of component (B);
from about 0.001 to about 0.015 g-eq/L of component (C);
from about 0.5 to about 6 g/L of component (D);
from about 7 to about 15 g/L of component (E); and
from about 0.001 to about 0.1M of component (F) if component (F) is selected from the group consisting of p-nitrobenzene sulfonic acid, water soluble salts thereof, and mixtures thereof and from about 0.0002 to about 0.02M of component (F) if component (F) is selected from the group consisting of water soluble salts of molybdic acids or mixtures thereof.

6. A composition according to claim 5 that has a free acid content in the range from about 0.0 to about 1.5 points, a total acid content in the range from about 5.0 to about 10 points, and a pH in the range from about 4.5 to about 5.2 and that comprises:
from about 0.30 to about 0.50 g/L of component (A);
from about 0.40 to about 0.70 g/L of component (B);
from about 0.0025 to about 0.0080 g-eq/L of component (C);
from about 0.5 to about 2.0 g/L of component (D);
from about 5 to about 12 g/L of component (E); and
from about 0.01 to about 0.1M of component (F) if component (F) is selected from the group consisting of p-nitrobenzene sulfonic acid, water soluble salts thereof, and mixtures thereof and from about 0.002 to about 0.002M of component (F) if component (F) is selected from the group consisting of water soluble salts of molybdic acids or mixtures thereof.

7. A composition according to claim 6, wherein component (F) is selected from water soluble salts of $H_2MoO_4$ and mixtures thereof.

8. A composition according to claim 6, wherein component (F) is selected from the group consisting of p-nitrobenzene sulfonic acid, salts thereof, and mixtures thereof.

9. A composition according to claim 4, wherein component (F) is selected from water soluble salts of $H_2MoO_4$ and mixtures thereof.

10. A composition according to claim 4, wherein component (F) is selected from the group consisting of p-nitrobenzene sulfonic acid, salts thereof, and mixtures thereof.

11. A process for forming a phosphate conversion coating on an active metal surface, said process comprising contacting the active metal surface with a liquid aqueous composition of matter that has a free acid content in the range from about 0 to about 2 points, a total acid content in the range from about 3 to about 15 points, and a pH in the range from about 3.0 to about 7.0 and that comprises water and:

(A) a water soluble component providing in aqueous solution from about 0.05 to about 1.0 g/L of dissolved complex fluoride anions selected from the group consisting of fluoborate ($BF_4^{-2}$), fluohafnate ($HfF_6^{-2}$), fluosilicate ($SiF_6^{-2}$), fluotitanate ($TiF_6^{-2}$), fluozirconate ($ZrF_6^{-2}$), and mixtures thereof;

(B) a water soluble component providing in aqueous solution from about 0.1 to about 2.0 g/L of stoichiometric equivalent as fluorine atoms of ions selected from the group consisting of fluoride ($F^-$), bifluoride ($HF_2^-$);

(C) from about 0.0005 to about 0.05 g-eq/L of a water soluble iron chelating agent component selected from molecules each of which contains at least two moieties selected from the group consisting of —COOH, —OH, and mixtures thereof;

(D) from about 0.1 to about 10 g/L, measured as the stoichiometric equivalent of hydroxylamine, of a water soluble component source of dissolved hydroxylamine;

(E) from about 3 to about 30 g/L of dissolved phosphate ions; and (F) from about 0.0001 to about 0.1M dissolved oxidizing agents selected from the group consisting of (i) p-nitrobenzene sulfonic acid, water soluble salts thereof, and mixtures thereof and (ii) water soluble salts of molybdic acids and mixtures thereof; and, optionally, (G) a total of up to about 100 g/L of one or more surfactants to promote cleaning of the metal surface to be treated; and, optionally, (H) up to about 100 g/L of a hydrotrope component to increase the solubility of the constituents of component (G); and, optionally, (J) a component of antifoam agent or agents,

12. A process according to claim 11, wherein the phosphate conversion coating formed has an a real density in the range from about 10 to about 1600 $mg/m^2$.

13. A process according to claim 12, wherein said liquid aqueous composition of matter comprises:
from about 0.05 to about 1 g/L of component (A);
from about 0.1 to about 2 g/L of component (B);
from about 0.002 to about 0.02 g-eq/L of component (C);
from about 0.1 to about 10 g/L of component (D);
from about 3 to about 30 g/L of component (E);
from about 0.001 to about 0.1M of component (F) if component (F) is selected from the group consisting of p-nitrobenzene sulfonic acid, water soluble salts thereof, and mixtures thereof and from about 0.0002 to about 0.02M of component (F) if component (F) is selected from the group consisting of water soluble salts of molybdic acids or mixtures thereof; and
from about 30 to about 60 g/L of component (G).

14. A process according to claim 13, wherein said liquid aqueous composition of matter has a free acid content in the range from 0 to about 1.0 points, a total acid content in the range from about 5 to about 10 points, and a pH in the range from about 4.2 to about 5.2 and comprises:

from about 0.10 to about 0.70 g/L of component (A);
from about 0.2 to about 0.8 g/L of component (B);
from about 0.001 to about 0.015 g-eq/L of component (C);
from about 0.5 to about 6 g/L of component (D);
from about 7 to about 15 g/L of component (E); and
from about 0.001 to about 0.1M of component (F) if component (F) is selected from the group consisting of p-nitrobenzene sulfonic acid, water soluble salts thereof, and mixtures thereof and from about 0.0002 to about 0.02M of component (F) if component (F) is selected from the group consisting of water soluble salts of molybdic acids or mixtures thereof.

15. A process according to claim 14, wherein said liquid aqueous composition of matter has a free acid content in the range from about 0.2 to about 1.0 points, a total acid content in the range from about 6.0 to about 9 points, and a pH in the range from about 4.5 to about 5.2 and comprises:

from about 0.30 to about 0.50 g/L of component (A);
from about 0.40 to about 0.70 g/L of component (B);
from about 0.0025 to about 0.008 g-eq/L of component (C);
from about 0.5 to about 2.0 g/L of component (D);
from about 7 to about 12 g/L of component (E); and
from about 0.001 to about 0.01M of component (F) if component (F) is selected from the group consisting of p-nitrobenzene sulfonic acid, water soluble salts thereof, and mixtures thereof and from about 0.0002 to about 0.002M of component (F) if component (F) is selected from the group consisting of water soluble salts of molybdic acids or mixtures thereof.

16. A process according to claim 11, wherein said liquid aqueous composition of matter comprises:

from about 0.05 to about 1 g/L of component (A);
from about 0.1 to about 2 g/L of component (B);
from about 0.0005 to about 0.05 g-eq/L of component (C);
from about 0.1 to about 10 g/L of component (D);
from about 3 to about 30 g/L of component (E);
from about 0.001 to about 0.1M of component (F) if component (F) is selected from the group consisting of p-nitrobenzene sulfonic acid, water soluble salts thereof, and mixtures thereof and from about 0.0002 to about 0.02M of component (F) if component (F) is selected from the group consisting of water soluble salts of molybdic acids or mixtures thereof; and
from about 30 to about 60 g/L of component (G).

17. A process according to claim 16, wherein said liquid aqueous composition of matter has a free acid content in the range from 0 to about 1.0 points, a total acid content in the range from about 5 to about 10 points, and a pH in the range from about 4.2 to about 5.2 and comprises:

from about 0.10 to about 0.70 g/L of component (A);
from about 0.2 to about 0.8 g/L of component (B);
from about 0.001 to about 0.015 g-eq/L of component (C);
from about 0.5 to about 6 g/L of component (D);
from about 7 to about 15 g/L of component (E); and
from about 0.001 to about 0.1M of component (F) if component (F) is selected from the group consisting of p-nitrobenzene sulfonic acid, water soluble salts thereof, and mixtures thereof and from about 0.0002 to about 0.02M of component (F) if component (F) is selected from the group consisting of water soluble salts of molybdic acids or mixtures thereof.

18. A process according to claim 17, wherein said liquid aqueous composition of matter has a free acid content in the range from about 0.2 to about 1.0 points, a total acid content in the range from about 6.0 to about 9 points, and a pH in the range from about 4.5 to about 5.2 and comprises:

from about 0.30 to about 0.50 g/L of component (A);
from about 0.40 to about 0.70 g/L of component (B);
from about 0.0025 to about 0.0080 g-eq/L of component (C);
from about 0.5 to about 2.0 q/L of component (D);
from about 7 to about 12 q/L of component (E); and
from about 0.001 to about 0.01 M of component (F) if component (F) is selected from the group consisting of p-nitrobenzene sulfonic acid, water soluble salts thereof, and mixtures thereof and from about 0.0002 to about 0.002M of component (F) if component (F) is selected from the group consisting of water soluble salts of molybdic acids or mixtures thereof.

19. A process according to claim 18, wherein component (F) is selected from the group consisting of p-nitrobenzene sulfonic acid, water soluble salts thereof, and mixtures thereof.

* * * * *